US007389717B1

(12) United States Patent
Shah et al.

(10) Patent No.: US 7,389,717 B1
(45) Date of Patent: Jun. 24, 2008

(54) MISSILE LAUNCH SYSTEM WITH HIGH-VOLUME ASSAULT CAPABILITY

(75) Inventors: Tushar K. Shah, Columbia, MD (US); Ashanna Randall, Baltimore, MD (US); Chandler P. McCann, Bowie, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 366 days.

(21) Appl. No.: 11/111,077

(22) Filed: Apr. 21, 2005

(51) Int. Cl.
*F41F 3/04* (2006.01)

(52) U.S. Cl. ..... 89/1.817; 89/1.816

(58) Field of Classification Search ..... 89/1.8–1.82
See application file for complete search history.

(56) References Cited

U.S. PATENT DOCUMENTS 5,837,917 A * 11/1998 Macnab et al. ..... 89/1.8
6,283,005 B1 * 9/2001 Yagla et al. ..... 89/1.816
2002/0170419 A1 * 11/2002 Borgwarth et al. ..... 89/1.81

* cited by examiner

*Primary Examiner*—Michael J. Carone
*Assistant Examiner*—Gabriel J Klein
(74) *Attorney, Agent, or Firm*—DeMont & Breyer LLC

(57) ABSTRACT

A missile launch system is disclosed that allows for the rapid reloading of missiles in support of missions (e.g., littoral warship missions, etc.) that require a high-volume assault of one or more targets. In particular, the illustrative embodiment of the present invention uses a munitions module that is capable of launching missiles and is able to fit inside a warship. In addition to accommodating multiple missiles, the munitions module accommodates one or more missile types. The munitions module is configured with a door at a breech end to provide access to multiple launch cells for the rapid reloading of missiles. The door is physically configured to define a plenum that couples the launch cells to an exhaust duct for the purpose of venting exhaust gases. The munitions module mitigates some of the problems associated with launch systems in the prior art.

20 Claims, 10 Drawing Sheets

MISSILE LAUNCH SYSTEM WITH HIGH-VOLUME ASSAULT CAPABILITY

FIELD OF THE INVENTION

The present invention relates to missilery in general, and, more particularly, to missile launchers.

BACKGROUND OF THE INVENTION

A missile launcher is capable of receiving, storing, and launching one or more missiles. Missile launchers-vertical missile launchers, in particular—have been developed for warships whose primary missions are in deep ("dark") water, far away from shore, where the target is typically about 70 kilometers or more away. FIG. 1 depicts two such vertical missile launchers, launchers 102-1 and 102-2, mounted on outside decks of warship 100 as is known in the prior art.

In some prior art arrangements, the vertical missile launchers are mounted below the deck in enclosed regions. FIG. 2 depicts a perspective-view of a Lockheed-Martin MK 41 vertical missile launch system, which is an example of a missile launch system known in the prior art. The MK 41 launch system can be located either above or below deck. Each cell of the vertical missile launcher houses a missile canister, which in turn houses a missile. Each missile must carry enough fuel for delivering the required munitions to a target, where the target can be considerably beyond the horizon. Because the missiles are big and heavy, owing to their mission, reloading the missiles can be a complex and slow process.

The need for warships that operate primarily in coastal areas (i.e., littoral waters), has increased in the past few years. These littoral warships have missions that generally require short-range missiles (i.e., missiles with ranges around 70 kilometers or less). In addition, littoral warships are often intended for missions in which multiple, smaller, closer targets are engaged (i.e., so called "small boat swarms,") which require the warship to fire missiles for a prolonged period of time. In short, the relatively smaller amount of heavy, long-range missiles that deep water warships carry is undesirable in a littoral warship because of the excessive firepower of each long-range missile, the insufficient number of missiles that are ready for launching at any given time, an inability to rapidly re-load missiles, and, in some cases, an inability to re-load missiles without returning to shore.

Shorter-range missiles, such as those that are desirable for a littoral warship, are usually launched from a horizontal or inclined position, not a vertical position. As a consequence, these types of missiles are typically launched from on-deck launchers. Unfortunately, most on-deck missile launchers have a substantial signature (e.g., infrared, radar, etc.) which decreases their likelihood of survivability.

Therefore, the need exists for a missile launch system that avoids or mitigates some or all of these problems.

SUMMARY OF THE INVENTION

The present invention provides a missile launch system that allows for the rapid reloading of missiles in support of missions (e.g., littoral-warship missions, etc.) that require a high-volume assault of one or more targets.

In the illustrative embodiment, the missile launch system comprises a munitions module that has a plurality of launch cells for launching a plurality of missiles. The missiles can be all of one type, or, alternatively, the module can store and launch different types of missiles at the same time. In some embodiments, the launch cells are dimensioned and arranged to facilitate the use of multiple types of missiles.

The munitions module is configured with a door at a breech end to provide access to the launch cells to rapidly reload missiles. In the illustrative embodiment, the door is physically configured to define a plenum that fluidically couples the launch cells to an exhaust duct for the purpose of venting missile exhaust gases.

The munitions module is able to fit within, or partially within, a warship. The munitions module is advantageously coupled to a region of the ship where missiles can be stored nearby for faster, easier reloading than with some arrangements in the prior art.

In accordance with the illustrative embodiment, the front of the munitions module is physically configured to complement a surface form of the warship, such as a wall or bulkhead, at the place on the warship where the module is located. In other words, the module can be tailored to fit inside a region on a ship that has normally unusable or underutilized space, such as up against an oblique corner of a room or an inclined wall on the ship. Locating the module inside the ship, in addition to facilitating reloading, advantageously reduces the ship's signature compared to some arrangements in the prior art.

In accordance with the illustrative embodiment of the present invention, a heat-transferring and shock-absorbing structure is disposed between each launch cell. The structure comprises pressurized water tubes that run the length of each launch cell. The multiple rows of tubes exhibit improved thermal and vibrational transfers of energy compared to some arrangements in the prior art.

In addition, the illustrative embodiment uses a controller that receives controlling signals, including launch-related commands and targeting information from a source that is away from the warship (i.e., an off-ship source). One example of an off-ship source is a helicopter that marks a target by using a laser. The helicopter "lases" the target, the controller launches the selected missile based on signals from the helicopter, and the missile seeks the target while being guided to the target by the laser. The helicopter crew can, of course, use the helicopter-based munitions, as appropriate, to supplement the fire-power of the munitions module.

The illustrative embodiment comprises: a plurality of elongated launch cells, wherein each launch cell has a breech end and a missile egress end, and wherein an axis defined between the breech end and the egress end is substantially horizontal; a door, wherein the door is proximal to the breech end of the plurality of launch cells and enables access thereto, and wherein the door is physically configured to define a plenum for receiving a flow of exhaust gases; and at least one duct for venting the exhaust gases, wherein the at least one duct is in fluidic communication with the plenum.

DETAILED DESCRIPTION

The following terms are defined for use in this Specification, including the appended claims:

A "missile" is defined as a projectile whose trajectory is not necessarily ballistic and can be altered during flight (e.g., as by a target-seeking radar or laser-based device, etc.). A missile is propelled by fuel and a chemical-propulsion engine. A chemical-propulsion engine propels a missile by the reaction that results from the rearward discharge of gases that are liberated when the fuel is burned.

Fluidic communication is defined as the flow of a fluid, such as exhaust gas, from one space or region to another. When two regions are said to be in fluidic communication with one another, a change in pressure, or gas flow in one of the regions can affect the pressure or flow in the other region.

Figure 1:
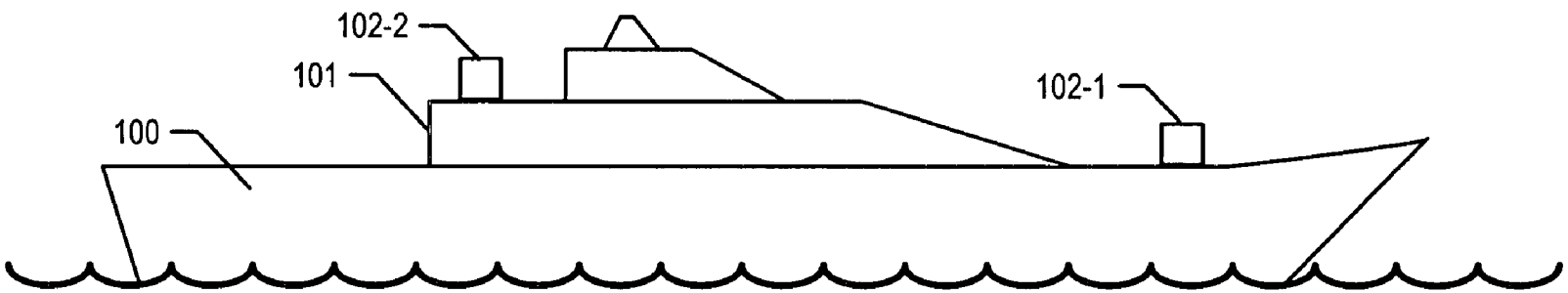
Figure 1 (Prior Art)
FIG. 1 depicts two vertical missile launchers mounted to the deck of a warship, as is known in the prior art.
Figure 2:
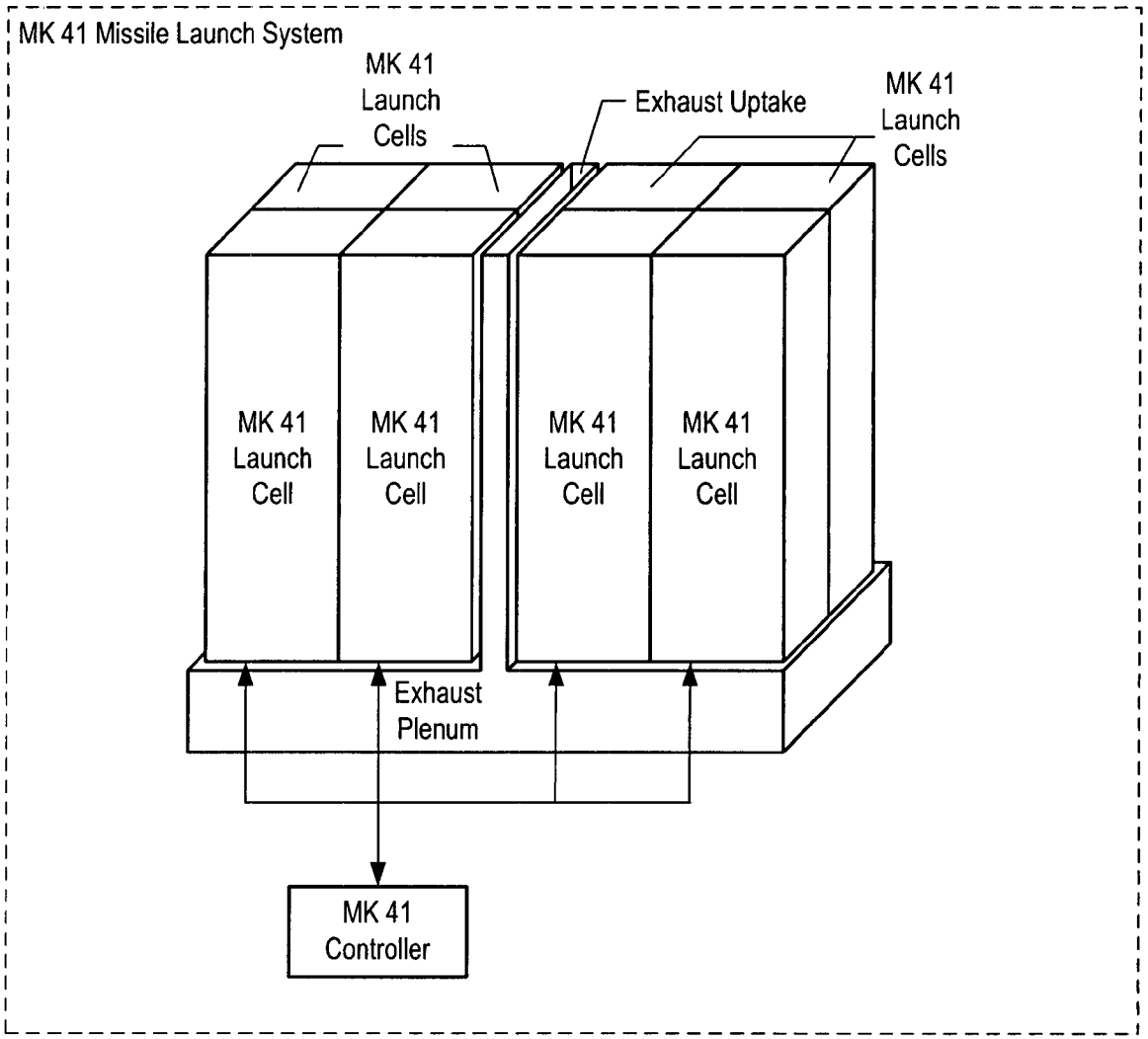
Figure 2 (Prior Art)
FIG. 2 depicts a perspective-view of a vertical missile launch system, which is an example of a missile launch system known in the prior art.
Figure 3A:
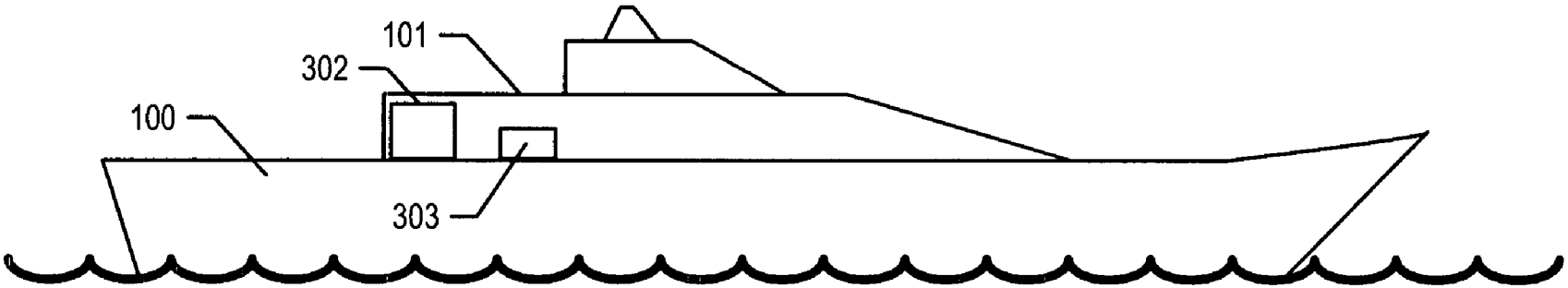
FIGS. 3A and 3B depict representational diagrams of a missile launch system in accordance with the illustrative embodiment of the present invention, wherein the missile launch system is disposed on a warship.
Figure 3B:
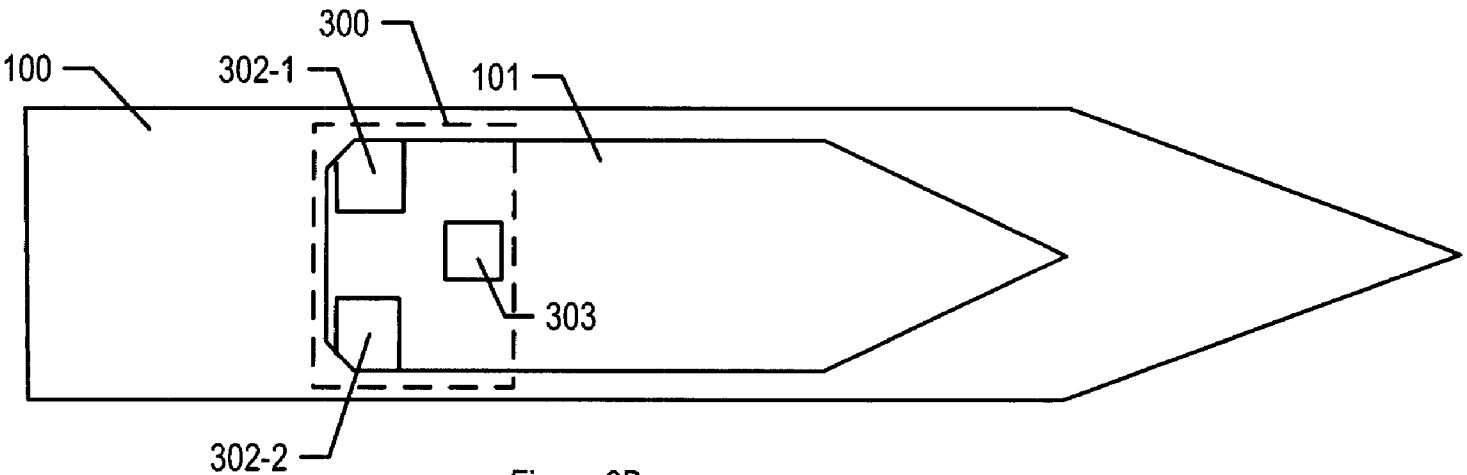

FIGS. 3A and 3B depict representational diagrams of a missile launch system that is disposed on warship 100, in accordance with the illustrative embodiment of the present invention. FIG. 3A depicts a side view and FIG. 3B depicts a top view of warship 100. Missile launch system 300 comprises munitions modules 302-*h* for h=1 through H (H=2 in the illustrative embodiment), and controller 303. Each munitions module 302-*h*, which, when referenced generically, is hereinafter referred to as "munitions module 302," is capable of accommodating one or more missiles, which are launched by using controller 303. Although FIGS. 3A and 3B depict a configuration for H equal to two, it will be clear to those skilled in the art, after reading this disclosure, how to make and use missile launch system 300 with a different number of munitions modules.

Missile launch system 300 is disposed at the aft end of deck 101, as depicted in FIGS. 3A and 3B. Munitions modules 302-1 and 302-2 are mounted at the left and right aft positions, respectively. The munitions modules are physically configured to fit alongside the outer walls of deck 101, thereby minimizing the additional space required to accommodate missile launch system 300. It will be clear to those skilled in the art, after reading this disclosure, how to make and use alternative embodiments of the present invention in which one or more munitions modules 302 are mounted on an outside deck of warship 100, are within or below a deck other than deck 101, are terrestrially-based (e.g., with ground troops, etc.), or are mounted on another type of vehicle (e.g., a truck, a railroad car, a submarine, a space vehicle, etc.).

Figure 4:
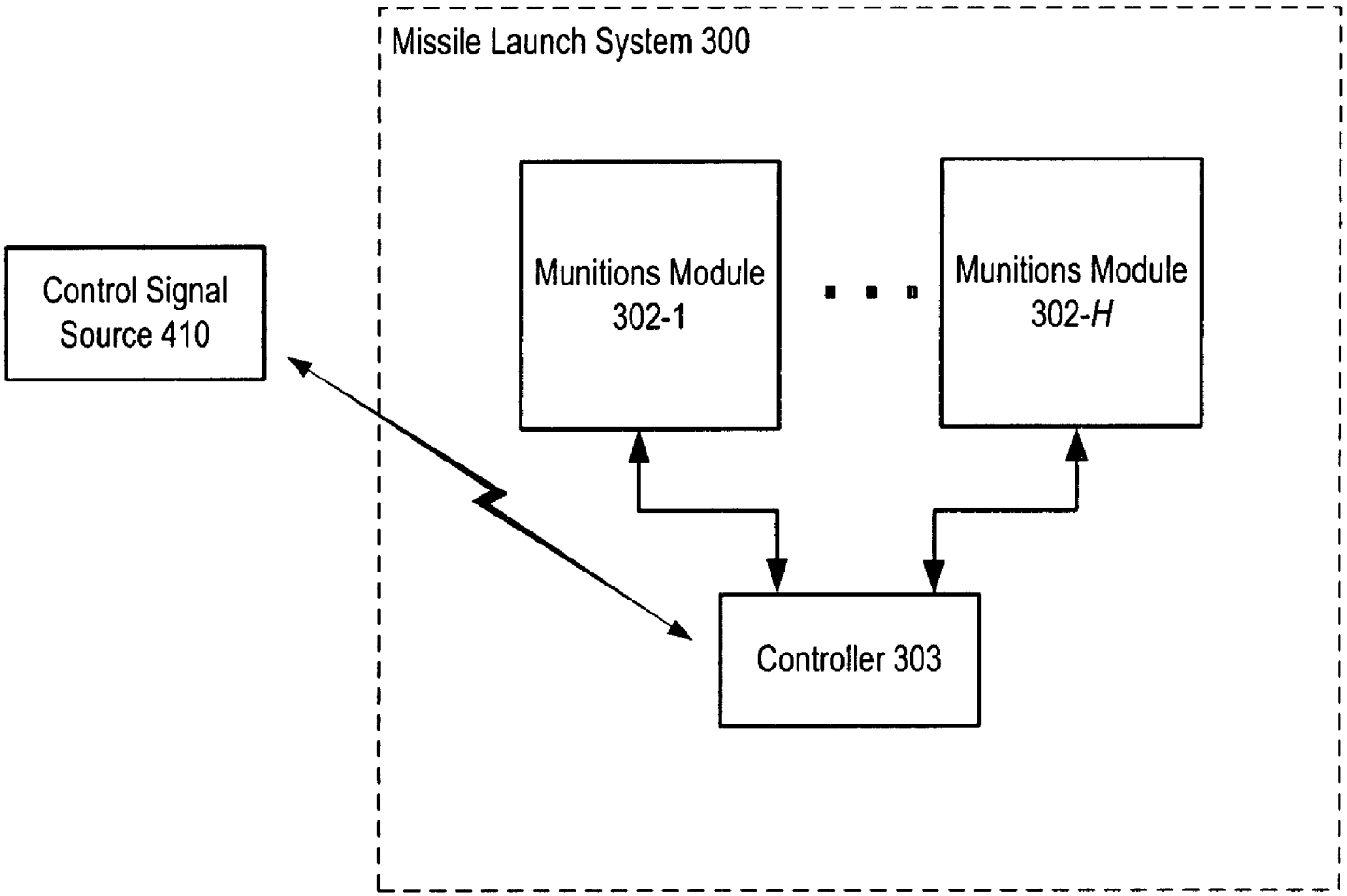
FIG. 4 depicts a block diagram of missile launch system 300, in accordance with the illustrative embodiment of the present invention.

FIG. 4 depicts a block diagram of missile launch system 300, in accordance with the illustrative embodiment of the present invention. Missile launch system 300 comprises munitions module 302-*h*, for h=1 through H, and controller 303, interconnected as shown. Munitions module 302 is described below and with respect to FIGS. 5 through 9. It will be clear to those skilled in the art, after reading this specification, how to make and use munitions module 302.

Controller 303 is capable of controlling munitions modules 302. Controller 303 is used to control the launching of one or more missiles, wherein the missiles can be a single type or different types. The data and information specific to the control and launch of each missile type for which each munitions module 302 is configured is stored by controller 303. Controller 303 is able to receive and accept control signals from onboard warship 100 or from an off-ship source, such as control signal source 410. Source 410 can be a helicopter, a fixed-wing aircraft (manned or unmanned), a ground-based force, and so forth. In some scenarios, source 410 will be in a position in which it can mark a target (e.g., with a laser, etc.) and then transmit the missile launch command to controller 303. Controller 303 is described below and with respect to FIG. 10. It will be clear to those skilled in the art, after reading this specification, how to make and use controller 303.

Figure 5:
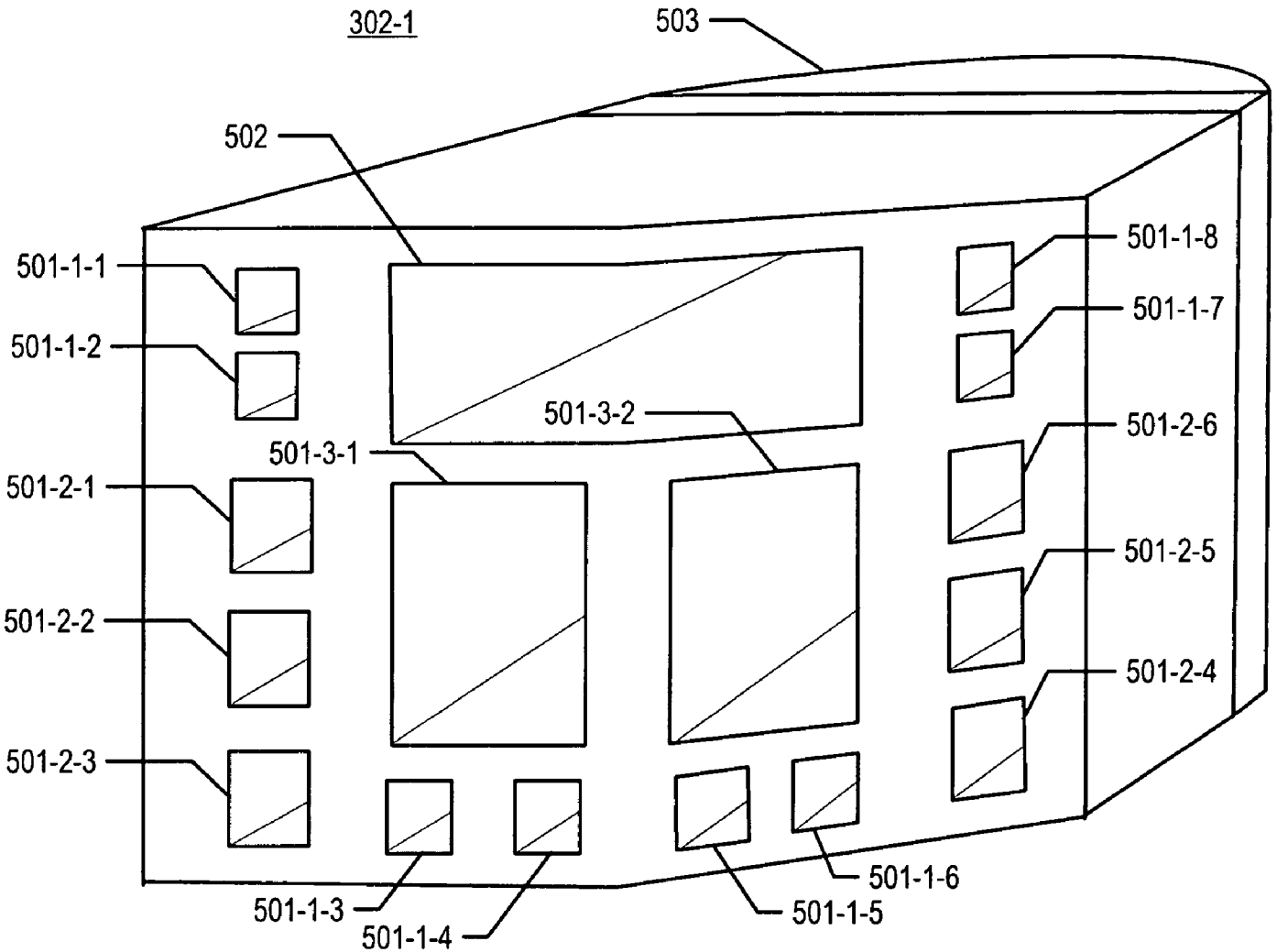
FIG. 5 depicts a first perspective view of munitions module 302-1, in accordance with the illustrative embodiment.

FIG. 5 depicts a first perspective view of munitions module 302, in accordance with the illustrative embodiment. Munitions module 302 comprises Type-1-launch cells 501-1-*i*, for i=1 through I; Type-2 launch cells 501-2-*j*, for j=1 through J; Type-3 launch cells 501-3-*k*, for k=1 through K; duct 502; and door 503, interrelated as shown. Type-1, Type-2, and Type-3 launch cells are for launching respective Type-1, Type-2, and Type-3 missiles. The missile types 1, 2, and 3 represent three different, non-specific missile types, each having a different size (e.g., cross-section, length, etc.). Although munitions module 302 is depicted for a configuration with I=8, J=6, and K=2, it will be clear to those skilled in the art, after reading this disclosure, how to make and use alternative embodiments of the present invention for different combinations of I, J, and K. It will also be clear to those skilled in the art, after reading this disclosure, how to make and use alternative embodiments with different physical configurations (e.g., a different number of missile types, a different arrangement of launch cells with respect to each other, etc.) than that depicted in FIG. 5.

Each launch cell of munitions module 302 has a breech end and a missile egress end, wherein the elongated launch cell extends between the breech end and missile egress end. In accordance with the illustrative embodiment, an axis defined between the breech end and missile egress end is substantially horizontal. In some alternative embodiments, the axis of at least some of launch cells 501 might be situated at angles that are other than horizontal.

Depicted in the foreground in FIG. 5 is the front end of munitions module 302, wherein the front end is proximal to the missile-egress ends of launch cells 501. Door 503 is proximal to the breech end. Munitions module 302 is shaped to fit in the left aft corner of deck 101 and, as such, is physically configured to complement a surface form (e.g., an outer wall, a bulkhead, etc.) of a region of warship 100. Accordingly, as depicted in FIG. 5, the right portion (as depicted) of the front end is angled inward to complement the wall of the left aft corner region of deck 101. As those who are skilled in the art will appreciate, in some alternative embodiments, the front end of munitions module 302 will have a different shape (e.g., flat, angled inward on the left portion, angled vertically instead of horizontally, etc.) than that depicted in FIG. 5, as is appropriate for the particular installation. Furthermore, in some embodiments, the openings at the missile egress ends of one or more launch cells can be covered by blast covers.

Within munitions module 302, the arrangement in which launch cells 501-*p*-*q*, for p=1 through P and q=1 through Q, are grouped is based on one or more factors, in accordance with the illustrative embodiment of the present invention. (P is equal to three and Q is dependent on i, j, and k, as depicted.) In some embodiments, the arrangement is based on the surface form of the region in which munitions module 302-*h* is disposed. In some other embodiments, the arrangement is based on a first type of missile, wherein the launch cells for the first type of missile are arranged in at least a first column (e.g., launch cells 501-1-1 and 501-1-2, etc.). In still some other embodiments, the arrangement is based on a second type of missile, wherein the launch cells for the second type of missile are arranged in at least a first row (e.g., launch cells 501-3-1 and 501-3-2, etc.). As those who are skilled in the art will appreciate, launch cells can be grouped, within munitions module 302, in additional arrangements that are based on other criteria.

Duct 502 and door 503, which is physically configured to define a plenum, constitute an exhaust system that is coupled with all launch cells 501 such that the exhaust system vents exhaust gases generated during the launch of a missile in one or all of launch cells 501. Duct 502 is used for venting the exhaust gases and, therefore, is in fluidic communication with the plenum in door 503. In accordance with the illustrative embodiment, a single duct 502 is positioned near the top of munitions module 302. In some alternative embodiments, duct 502 overlies at least some of launch cells 501. Also, in some other embodiments, munitions module 302 includes one or more ducts in addition to duct 502. Duct 502 and door 503 are described in detail below and with respect to FIGS. 8 and 9.

Figure 6:
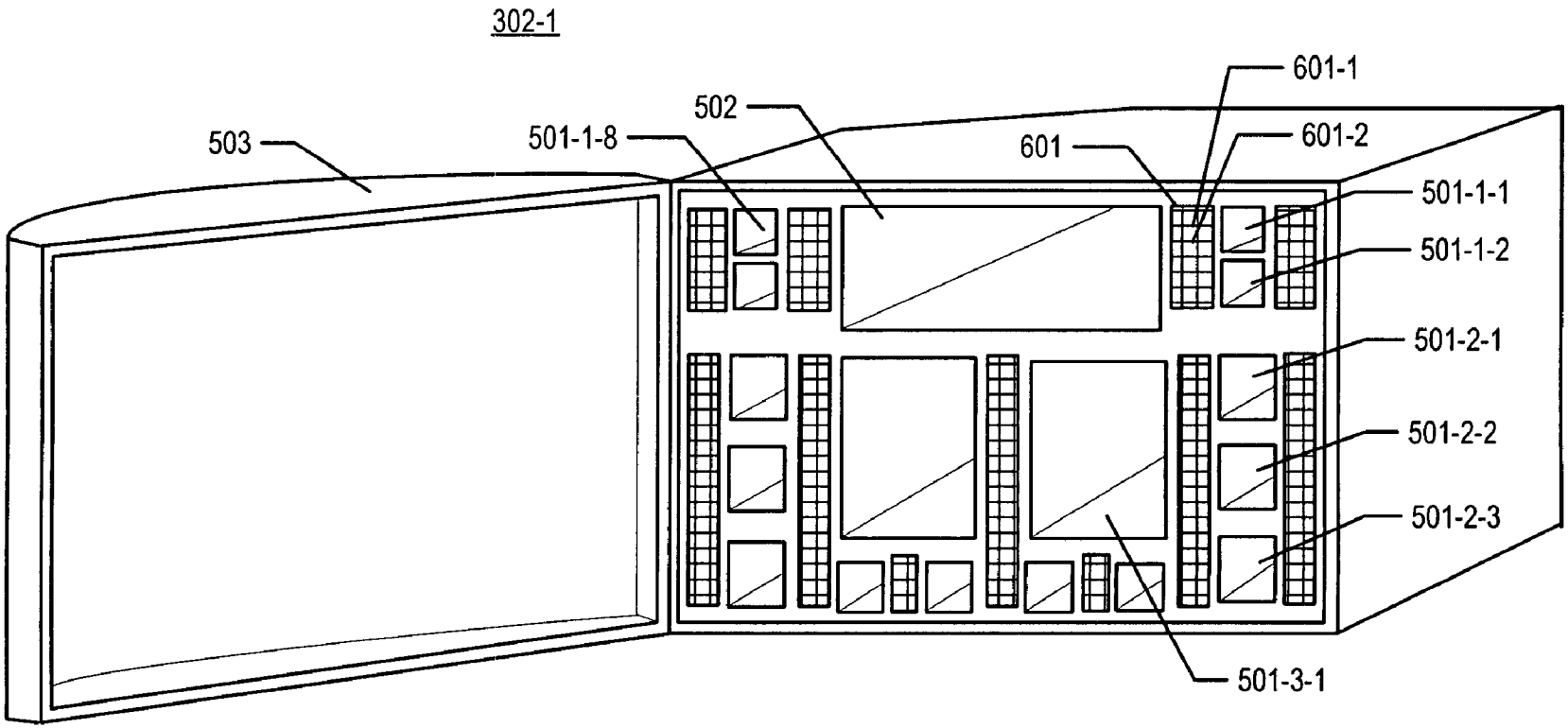
FIG. 6 depicts a second perspective view of munitions module 302-1, as seen from the breech end and in accordance with the illustrative embodiment.

FIG. 6 depicts a second perspective view of munitions module 302, as seen from the breech end and in accordance with the illustrative embodiment. Depicted as seen from the breech end are Type-1 launch cells 501-1-*i*, Type-2 launch cells 501-2-*j*, and Type-3 launch cells 501-3-*k*. Door 503 is shown in an open position, which reveals the plenum space that receives a flow of exhaust gases from launch cells 501 when door 503 is closed and one or more missiles are launched.

Structure 601 is one of several barriers that are disposed between one or more groups of launch cells 501, and that extend from the breech end to the front end of munitions module 302. Structure 601 comprises a physical adaptation for removing heat from one or more of launch cells 501-*p*-*q*. In addition to transferring heat during a missile launch, structure 601 also is able to absorb shock and minimize vibration. In accordance with the illustrative embodiment, structure 601 comprises a plurality of tubes (e.g., tube 601-1, tube 601-2, etc.) that are physically adapted to absorb shock and remove heat from launch cells 501. The tubes contain a pressurized liquid (e.g., water, etc.), wherein each of the tubes is substantially parallel to one or more launch cells 501-*p*-*q*. As those who are skilled in the art will appreciate, in some alternative embodiments, structure 601 can be made up of other materials with heat-transferring and shock-absorbing properties.

Figure 7:
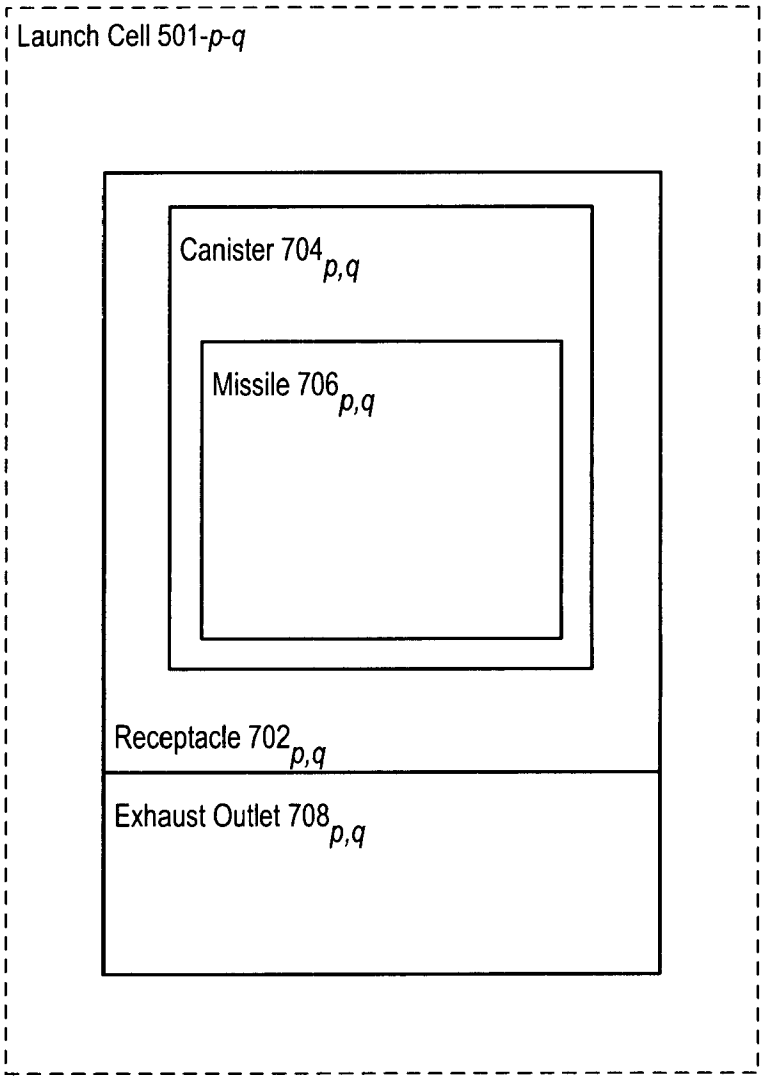
FIG. 7 depicts a block diagram of launch cell 501-*p*-*q*, in accordance with the illustrative embodiment.

FIG. 7 depicts a block diagram of launch cell 501-*p*-*q*, in accordance with the illustrative embodiment. Launch cell 501-*p*-*q* comprises receptacle $\mathbf{702}_{p,q}$, missile canister $\mathbf{704}_{p,q}$, missile $\mathbf{706}_{p,q}$, and exhaust outlet $\mathbf{708}_{p,q}$, which are well-known in the art.

Receptacle $\mathbf{702}_{p,q}$ locates and secures missile canister $\mathbf{704}_{p,q}$, which contains missile $\mathbf{706}_{p,q}$, in well-known fashion. Exhaust outlet $\mathbf{708}_{p,q}$ provides a path through which the exhaust gases generated by missile $\mathbf{706}_{p,q}$ during launch can escape from launch cell 501-*p*-*q* towards the plenum space of door 503. The size of receptacle $\mathbf{702}_{p,q}$ is determined by the type of missile canister $\mathbf{704}_{p,q}$. Different types of missiles (e.g., short-range types, etc.) are contained in missile canisters of different sizes. Therefore, in order to enable munitions module 302-*h* to accommodate different missile types, in addition to the size of launch cell 501-*p*-*q* being reconfigurable, the size of receptacle $\mathbf{702}_{p,q}$ is reconfigurable, as well as the position of exhaust outlet $\mathbf{708}_{p,q}$.

In some alternative embodiments, launch cell 501-*p*-*q* and receptacle $\mathbf{702}_{p,q}$ are combined into the same structure. For example, in those embodiments launch cell 501-*p*-*q* might directly locate and secure missile canister $\mathbf{704}_{p,q}$ without a separate receptacle $\mathbf{702}_{p,q}$.

Figure 8:
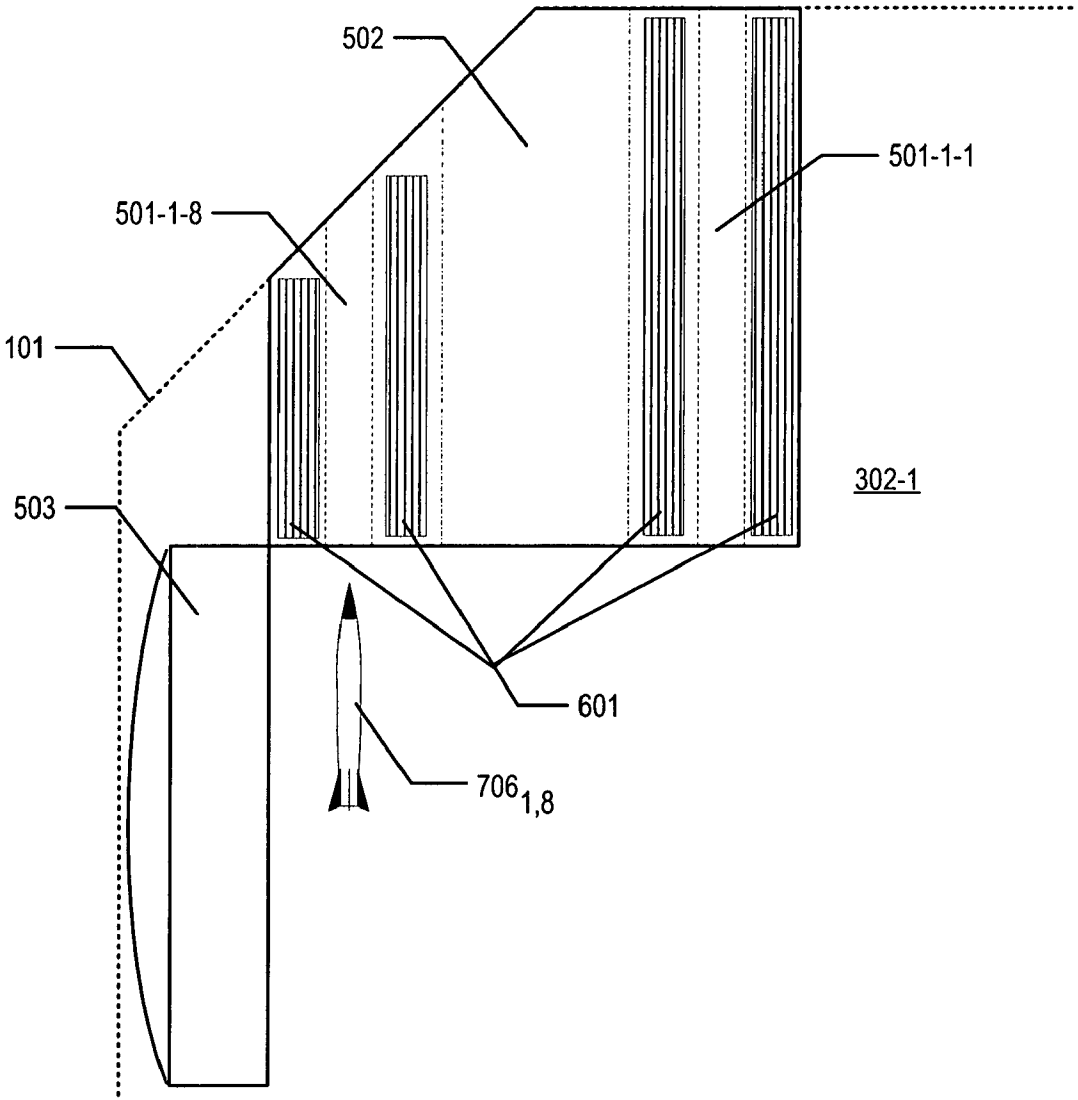
FIG. 8 depicts a first cross-sectional view, as viewed from the top of munitions module 302-1, in accordance with the illustrative embodiment of the present invention.

FIG. 8 depicts a first cross-sectional view, as viewed from the top of munitions module 302, in accordance with the illustrative embodiment of the present invention. The view depicts a cross-section of munitions module 302 that cuts across launch cells 501-1-1 and 501-1-8, portions of structure 601, and duct 502. Door 503 is shown in an open position, allowing illustrative missile $\mathbf{706}_{1,8}$ to be loaded into the breech end of munitions module 302, into launch cell 501-1-8. Door 503 is able to (i) open for the purpose of loading one or more launch cells 501 with missiles and (ii) close for the purpose of securing the breech end of munitions module 302-1 for missile firing and for the subsequent venting of gases. Note that munitions module 302-1 is disposed near the left aft corner, outer walls of deck 101.

Figure 9:
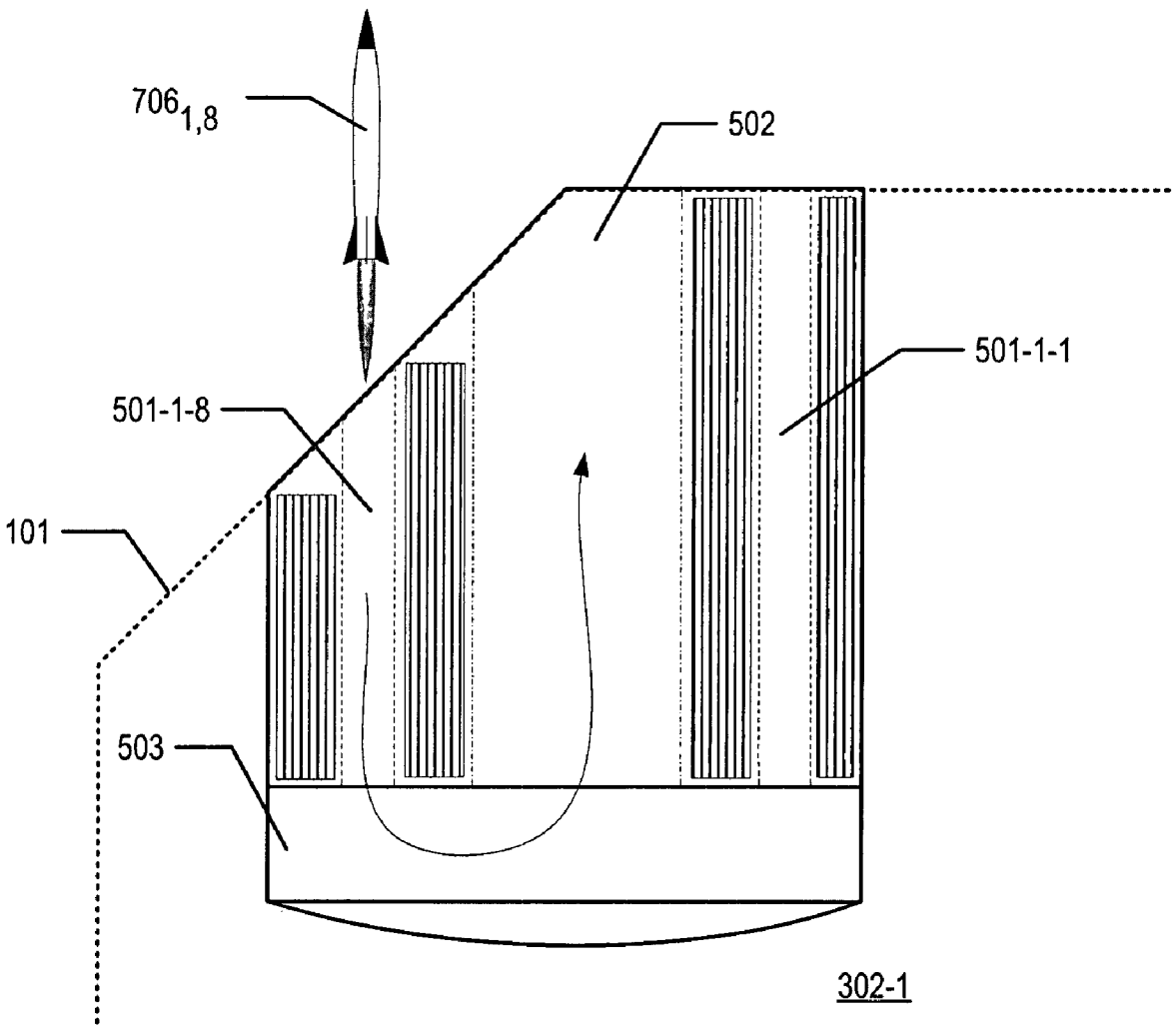
FIG. 9 depicts a second cross-sectional view, as viewed from the top of munitions module 302-1, in accordance with the illustrative embodiment of the present invention.

FIG. 9 depicts a second cross-sectional view, as viewed from the top of munitions module 302-1, in accordance with the illustrative embodiment of the present invention. The view depicts a cross-section of munitions module 302-1 that cuts across launch cells 501-1-1 and 501-1-8, portions of structure 601, and duct 502. Door 503 is shown in the closed position. When missile $\mathbf{706}_{1,8}$ is fired, as shown exiting the missile-egress end of launch cell 501-1-8, the exhaust gas first flows through launch cell 501-1-8 at the breech end. The plenum space in door 503 then enables the exhaust gas to flow to duct 502, in accordance with the illustrative embodiment of the present invention. Finally, the exhaust gas flows through duct 502 from the breech end to the front end and is emitted through the duct opening, or "uptake," and out of munitions module 302.

In some alternative embodiments, door 503 is replaced with a structure that comprises one or more hatches and a plenum. For example, such a structure is secured to the breech end of launch cells 501 to allow for the flow of exhaust gases and could be fitted with multiple hatches on its rear side to allow for the reloading of missiles.

Figure 10:
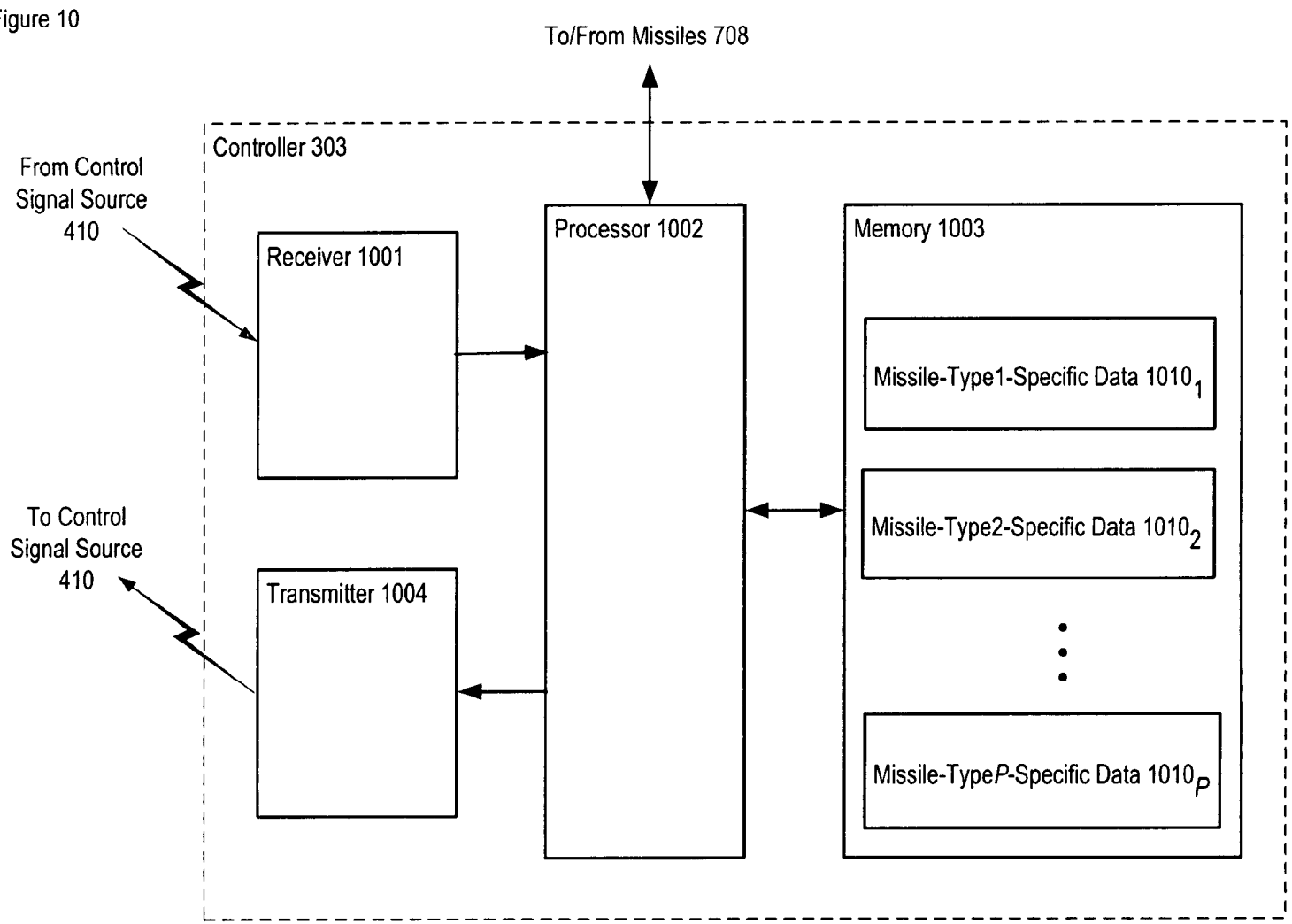
FIG. 10 depicts a block diagram of controller 303, in accordance with the illustrative embodiment of the present invention.

FIG. 10 depicts a block diagram of controller 303, in accordance with the illustrative embodiment of the present invention. Controller 303 comprises receiver 1001, processor 1002, memory 1003, and transmitter 1004, interconnected as shown.

Receiver 1001 receives signals from control signal source 410 and forwards the information encoded in these signals (e.g., launch commands, etc.) to processor 1002, in well-known fashion. It will be clear to those skilled in the art, after reading this specification, how to make and use receiver 1001.

Processor 1002 is a general-purpose processor that is capable of receiving information from receiver 1001, of executing instructions stored in memory 1003, of reading data from and writing data into memory 1003, and of transmitting information to transmitter 1004. Processor 1002 is also capable of transmitting signals to one or more launch cells 501 for the purpose of launching missiles, in well-known fashion. In some alternative embodiments of the present invention, processor 1002 might be a special-purpose processor. In either case, it will be clear to those skilled in the art, after reading this specification, how to make and use processor 1002.

Memory 1003 stores data and executable instructions, as is well-known in the art, and might be any combination of random-access memory (RAM), flash memory, disk drive memory, and so forth. Memory 1003 comprises P data sets 810*p*, wherein p is a positive integer in the set {1, . . . , P}. Each data set 810*p* includes data and information specific to the control and launch of one of the P missile types for which munitions module 302 can be configured to accommodate. It will be clear to those skilled in the art how to make and use memory 1003.

Transmitter 1004 receives information (e.g., acknowledgments to commands, etc.) from processor 1002 and transmits signals that encode this information to control signal source 410, in well-known fashion. It will be clear to those skilled in the art, after reading this specification, how to make and use transmitter 1004.

It is to be understood that the above-described embodiments are merely illustrative of the present invention and that many variations of the above-described embodiments can be devised by those skilled in the art without departing from the scope of the invention. For example, in this Disclosure, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the disclosure to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Disclosure are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising:

a plurality of elongated launch cells, wherein each launch cell has a breech end and a missile egress end, and wherein an axis defined between said breech end and said egress end is substantially horizontal;

a door, wherein said door is proximal to said breech end of said plurality of launch cells and enables the loading of missiles at said breech end of said plurality of launch cells when said door is in an open position, and wherein said door is physically configured to define a plenum for receiving a flow of exhaust gases when said door is in the closed position; and at least one duct for venting said exhaust gases, wherein said at least one duct is in fluidic communication with said plenum.

2. The apparatus of claim 1 further comprising a first structure, wherein said first structure is disposed between said launch cells, and further wherein said first structure absorbs shock.

3. The apparatus of claim 2 wherein said first structure comprises a physical adaptation for removing heat from said launch cells.

4. The apparatus of claim 2 wherein said first structure comprises a plurality of tubes.

5. The apparatus of claim 3 wherein said first structure comprises a plurality of tubes, and further wherein said tubes are filled with a liquid.

6. The apparatus of claim 1 wherein said plurality of launch cells is able to accommodate at least two different types of short-range missiles.

7. The apparatus of claim 1 wherein said apparatus is disposed on a ship, and further comprising a controller for launching said missiles from said launch cells, and further wherein said controller accepts control signals from off-ship source.

8. The apparatus of claim 7 wherein said off-ship source is a helicopter.

9. An apparatus comprising:

a plurality of elongated launch cells, wherein each launch cell has a breech end and a missile egress end;

a door, wherein said door is proximal to said breech end of said plurality of launch cells and enables the loading of missiles at said breech end of said plurality of launch cells when said door is in an open position, and wherein said door is physically configured to define a plenum for receiving a flow of exhaust gases when said door is in the closed position;

at least one duct for venting said exhaust gases, wherein said at least one duct is in fluidic communication with said plenum; and a plurality of tubes disposed between said launch cells, wherein said tubes are physically adapted to absorb shock and remove heat from said launch cells.

10. The apparatus of claim 9 wherein said tubes contain a pressurized liquid, wherein each of said tubes is substantially parallel to said plurality of launch cells.

11. The apparatus of claim 9 wherein said duct overlies at least some of said launch cells.

12. The apparatus of claim 9 wherein said plurality of launch cells are substantially horizontal.

13. The apparatus of claim 9 wherein said plurality of launch cells are contained within a module, wherein said module is disposed on a region of a ship, and wherein at least said front end of said module is physically configured to complement a surface form of said region.

14. The apparatus of claim 13 wherein, within said module, said plurality of launch cells are grouped in a first arrangement, and wherein said arrangement is based on said surface form of said region of said ship.

15. The apparatus of claim 13 wherein, within said module, said plurality of launch cells are grouped in a first arrangement, and wherein within said first arrangement, launch cells for launching a first type of missile are arranged in at least a first column.

16. The apparatus of claim 15 wherein, within said module, said plurality of launch cells are grouped in a first arrangement, and wherein within said first arrangement, launch cells for launching a second type of missile are arranged in at least a first row.

17. An apparatus comprising a munitions module, wherein said munitions module comprises:

(i) a plurality of elongated launch cells, wherein each launch cell has a breech end and a missile egress end, and wherein an axis defined between said breech end and said egress end is substantially horizontal; and (ii) a door, wherein said door is proximal to said breech end of said plurality of launch cells and enables the loading of missiles at said breech end of said plurality of launch cells when said door is in an open position, and wherein said door is physically configured to define a plenum for receiving a flow of exhaust gases when said door is in the closed position;

wherein said munitions module is disposed on a region of a ship, and wherein at least said front end of said module, which is proximal to said missile egress end of said launch cells, is physically configured to complement a surface form of said region.

18. The apparatus of claim 17 wherein, within said module, said plurality of launch cells are grouped in a first arrangement, and wherein said arrangement is based on said region of said ship.

19. The apparatus of claim 17 wherein, within said module, said plurality of launch cells are grouped in a first arrangement, and wherein said arrangement is based on said surface form of said region of said ship.

20. The apparatus of claim 17 wherein said flow of exhaust gases is directed toward said front end of said module.

* * * * *